US005662562A

United States Patent [19]

Wohlenberg

[11] Patent Number: 5,662,562

[45] Date of Patent: Sep. 2, 1997

[54] LEG EXERCISE DEVICE

[75] Inventor: Robert Martin Wohlenberg, Adelaide, Australia

[73] Assignee: Orthopaedic Rehabilitation Products Pty Ltd, Flinders Park, Australia

[21] Appl. No.: 592,335

[22] PCT Filed: Jun. 2, 1995

[86] PCT No.: PCT/AU95/00328

§ 371 Date: Feb. 2, 1996

§ 102(e) Date: Feb. 2, 1996

[87] PCT Pub. No.: WO95/33526

PCT Pub. Date: Dec. 14, 1995

[30] Foreign Application Priority Data

Jun. 3, 1994 [AU] Australia ..... PM6063

[51] Int. Cl.[6] ..... A63B 26/00

[52] U.S. Cl. ..... 482/91; 482/907

[58] Field of Search ..... 482/91, 907; 601/33, 601/34

[56] References Cited

U.S. PATENT DOCUMENTS 2,058,563 10/1936 Campbell .
4,463,947 8/1984 Kloenne .
4,599,996 7/1986 Seith et al. ..... 601/34
4,784,121 11/1988 Brooks ..... 601/34
4,844,454 7/1989 Rodgers .
5,074,549 12/1991 Harvey .
5,236,333 8/1993 Barba, Jr. ..... 601/34
5,328,426 7/1994 Vendette ..... 482/907
5,333,604 8/1994 Green et al. ..... 601/34

FOREIGN PATENT DOCUMENTS 94-063108/08 12/1993 Sweden .

*Primary Examiner*—Lynne A. Reichard
*Attorney, Agent, or Firm*—Watts, Hoffmann, Fisher & Heinke Co., LPA

[57] ABSTRACT

A leg exercising device for exercising the knee joint of a patient's leg is disclosed. The device includes an elongate lever which is a rod having a cradle at one end to cradle a lower portion of a patient's leg. A fulcrum member is carried on the rod intermediate its ends and is shaped to bear against a patient's leg near its knee joint which a patient's lower leg portion is cradled. A handle is on the rod end opposite the cradle and is useable by a patient to effect articulation of a knee joint. A distance adjustment means is between the fulcrum member and the cradle. In one embodiment the rod consists of two end connected pieces.

9 Claims, 4 Drawing Sheets

LEG EXERCISE DEVICE

This invention relate to a device for the exercising of a leg, and although not necessarily limited to assisting a patient to straighten a leg in post-operative physio therapy, the invention is specifically useful in such a situation. The invention further extends to a method of exercising a leg which tends to remain bent at the knee.

The knee is the joint which is frequently damaged in injuries for example sport injuries, and quite often needs major surgery. Frequency, after the surgery has been completed the knee has moved to a bent position instead of the stretched out position and it is necessary to subject a patient to considerable physiotherapy before full use is resumed. In order to achieve straightening of the leg at the knee, it is common practice to subject the knee to a considerable weight or force which tends to slowly straighten the leg, but this is painful and has been found to be less effective than being able to "work" the knee joint and thereby achieve the required physical changes to make the knee once again useful.

BACKGROUND OF THE INVENTION

In an embodiment of the invention there is provided means which support the ankle or heel of a patient and apply pressure downwardly near the knee joint intermittently, and enable the knee joint to "work", that is, to articulate so as to reduce resistance to use.

A particular useful embodiment of the invention utilises an elongate lever having a cradle at one end which can cradle the heel or behind the ankle of a patient's leg, and intermediate the ends a fulcrum member is carried adjustably for position on the lever and shaped to bear against the patient's leg near the locality of the knee while the other end of the lever is provided with a handle so that a user can use his hand and arm to effect articulation of the knee joint.

PRIOR ART

No prior art is known to the Applicant wherein use is made of an elongate bar having a cradle at one end to accept the heel of a patient, a handle at the other end, and a fulcrum between the ends which can engage a patient's leg near the knee joint. The closest art appears to be in U.S. Pat. Nos. 4,463,947 Kloenne, and 4,844,454 Rogers.

Specifically, the invention consists of an elongate lever having a cradle at one end of shape to cradle a lower portion (the heel or ankle) of a patient's leg, a fulcrum member carried on said lever intermediate its ends and shaped to bear against a patient's said leg near its knee joint when said one end cradles said lower leg portion, the other of said ends comprising a handle useable by a patient to effect articulation of said knee joint.

BRIEF SUMMARY OF THE DRAWINGS

Two embodiments of the invention are described hereunder in some detail with reference to, and are illustrated in, the accompanying drawings, in which

Referring firstly to the embodiment of FIGS. 1 to 5, a leg exercise device 10 comprises an elongate lever 11 which has a depending hook like cradle 12 at the lower end arranged to engage either the heel to behind the ankle of a patient's leg, while intermediate the ends of the lever 11 is provided with a saddle 13 which is slidable along the lever 11 but can be located in alternative positions by means of an insertion pin 14 which is selectively inserted in any one of a plurality of apertures which extend through a wall of lever 11 for part of its length. A strut 15 extends from the saddle 13 and is joined at its other end to a shallow U shaped bracket 16 which carries a pressure plate 17, by pivot pin 18, such that plate 17 and pin 18 combine to form a fulcrum. The end of the lever 11 which is spaced furthest from the cradle 12, terminates in a handle 20 which can be actuated by a patient, and if the patient moves the handle 20 he can cause the knee to articulate, and if he does so intermittently he can control the frequency and amplitude of movement which is developed. It has been found surprisingly that it is better to apply the load intermittently within a range of pair tolerance, particularly if done by hand, and the resultant correction of the knee joint is more effective and more quickly and easily achieved than heretofore. FIGS. 4 and 5 respectively show the pressure plate 17 bearing against the leg below and above the patient's knee.

FIG. 6 shows an alternative arrangement, wherein the leg exercise device 21 has a "broken" lever comprising an upper portion **22*a* and a lower portion 22*b*, handle 23 being on an end of portion 22*a*, and cradle 24 on an end of the lower portion 22*b***.

Figure 1:
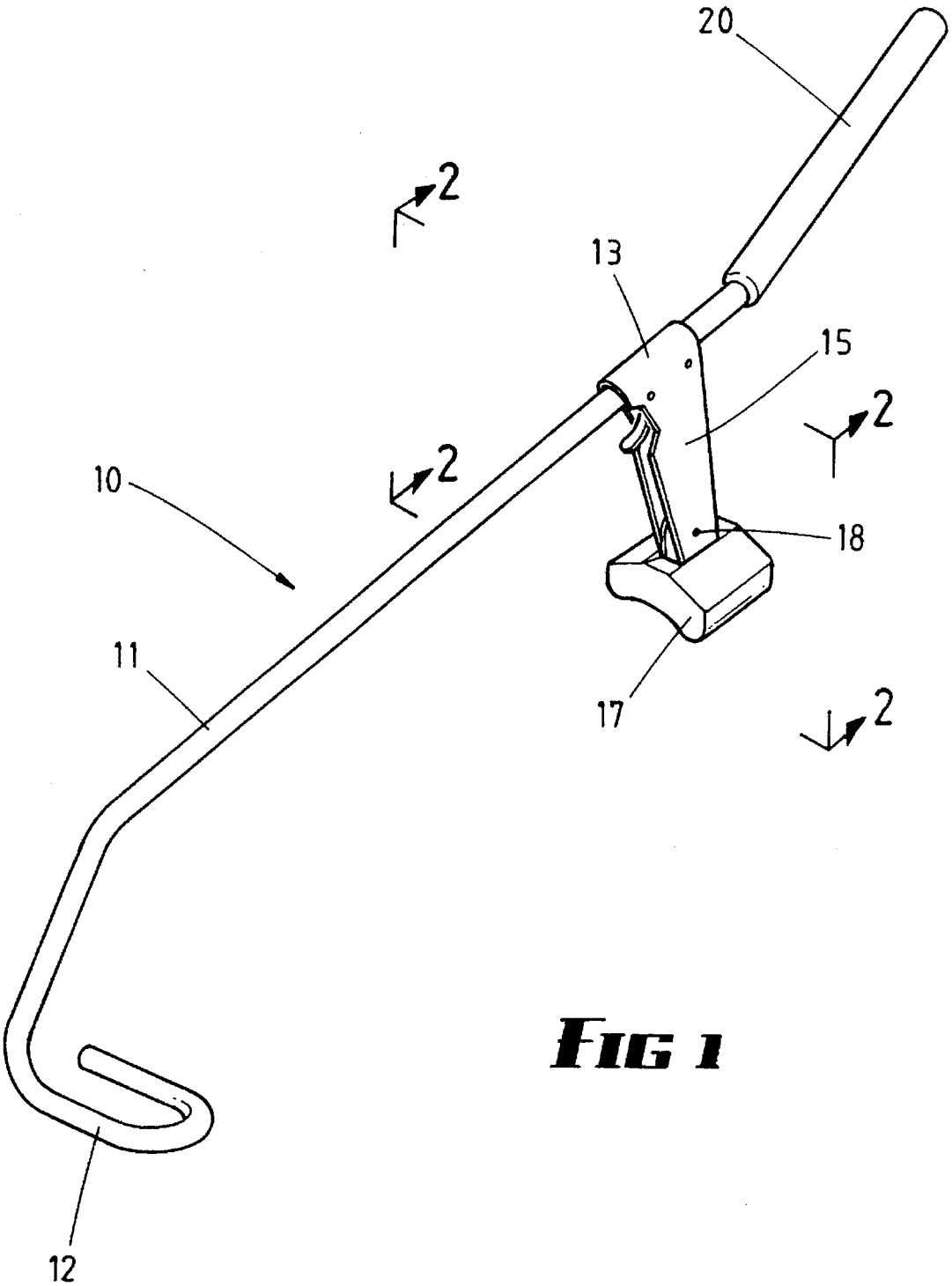
FIG. 1 is a perspective view of a leg exercising device, according to a first embodiment.
Figure 3:
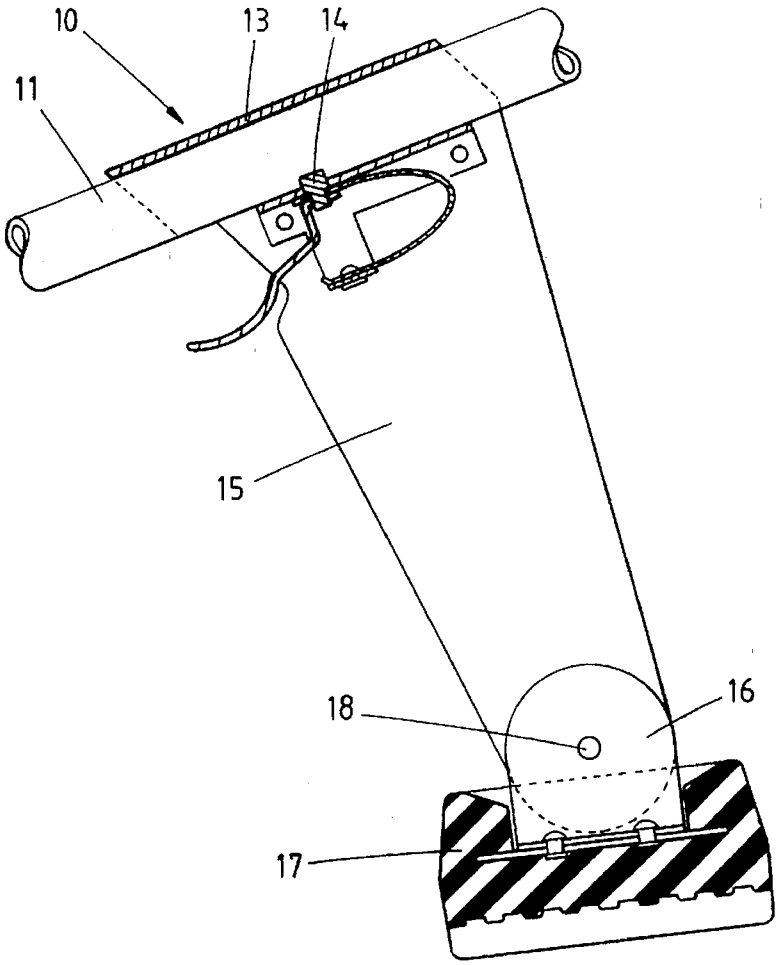
FIG. 3 is a fragmentary longitudinal section on plane 3—3 of FIG. 2.
Figure 2:
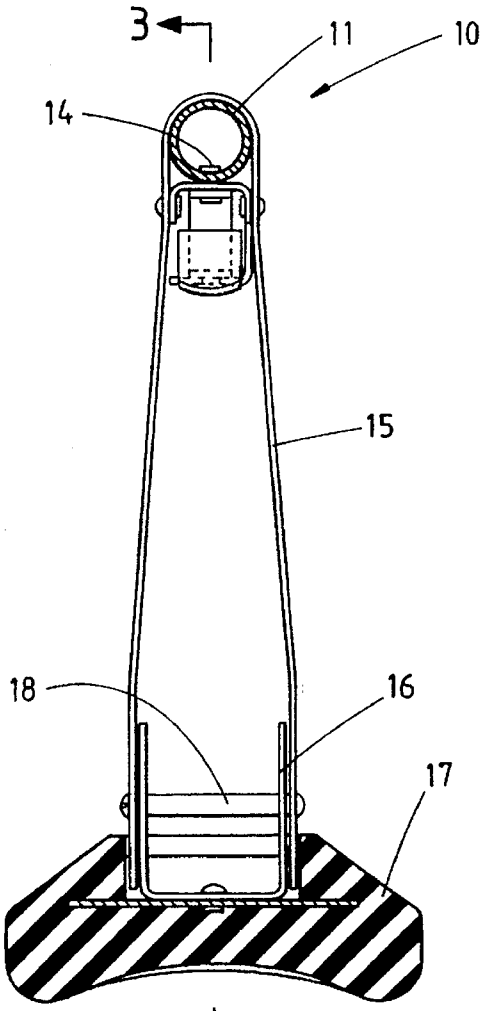
FIG. 2 is a cross-section on plane 2—2—2—2 of FIG. 1.
Figure 4:
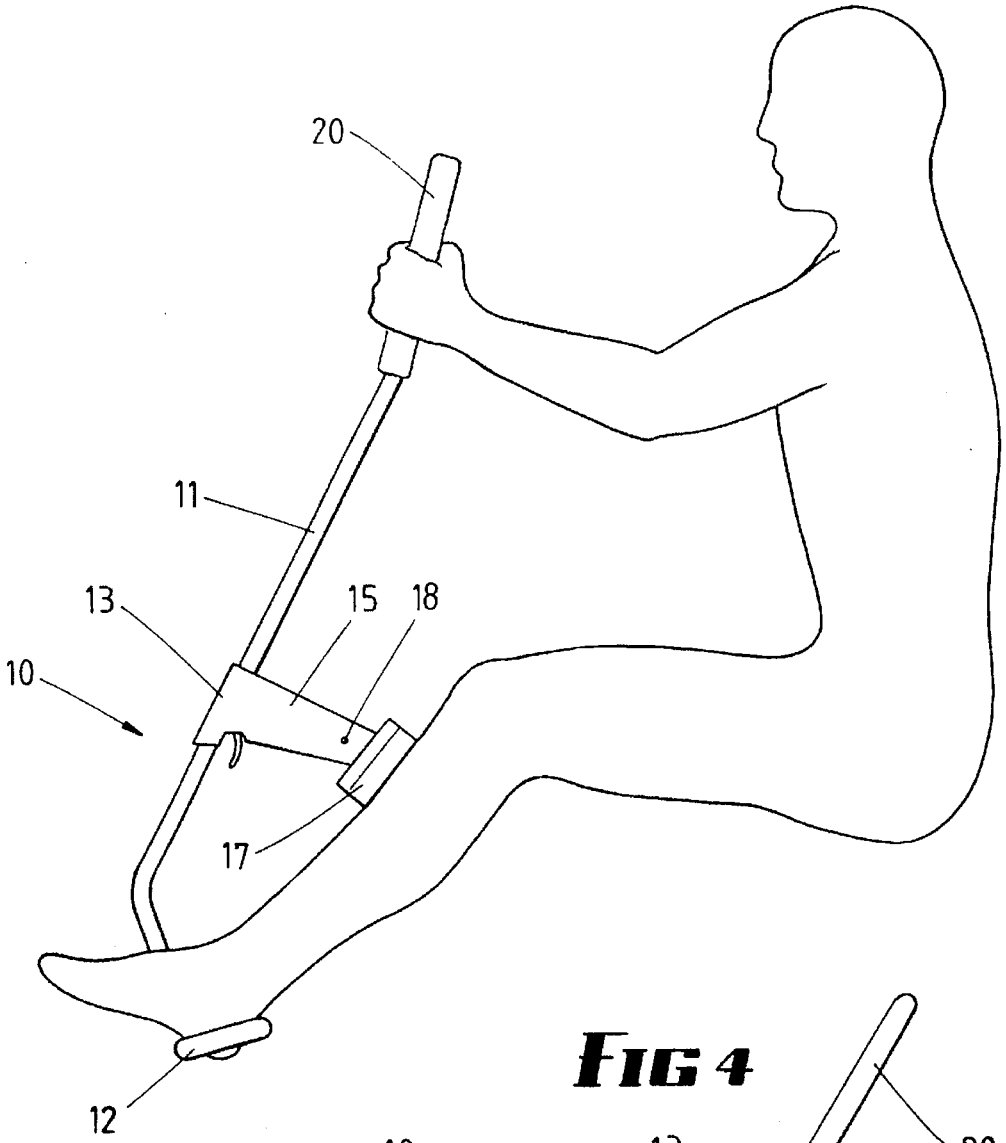
FIG. 4 shows use of the first embodiment device with the fulcrum below the knee.
Figure 5:
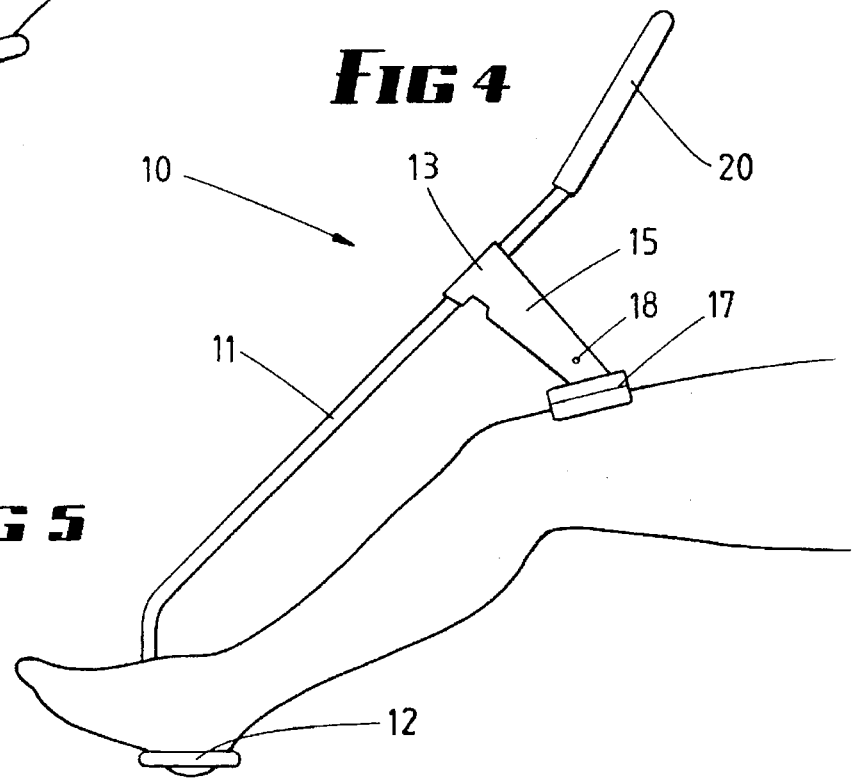
FIG. 5 is a view similar to FIG. 2, but with the fulcrum above the knee.
Figure 6:
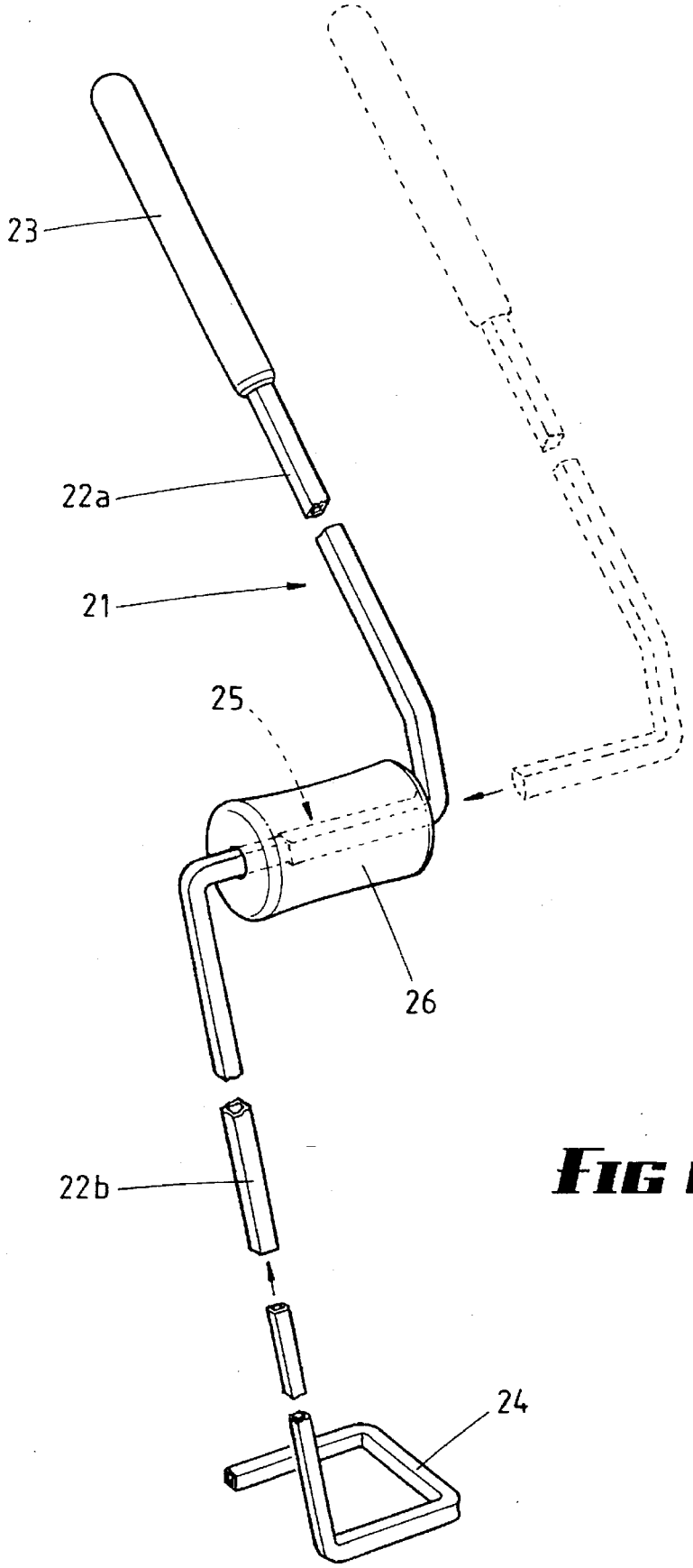
FIG. 6 depicts an alternative arrangement wherein components can be "knocked down" to occupy less packaging space than the first embodiment.

The two portions **22*a* and 22*b* both comprise square tubing, and are joined intermediate their ends by a telescopic joint at 25 in laterally extending adjacent ends of the handle portions. The laterally extending adjacent ends at 25 carry a contoured resilient pad 26, retained in position by the extending portions 22*a* and 22*b*** of the lever.

As shown, portion **22*b* is telescopic also at its lower end, so that cradle 24** can also be removed for packaging, or positioned for the most effective use of the device.

The second embodiment has certain advantages over the first. There is no latch arrangement, such as insertion pin 14, friction between the telescopic sliding surfaces being sufficient to retain the lower portions in their adjusted positions. The cost of the pad 26 (which functions as the fulcrum member) is much less than the cost of the fulcrum member of the first embodiment.

A consideration of the above embodiments will indicate that the invention is very simple, but experiments have indicated that it is likely to be very much more effective than the "dead weight" system which has been used in prior art.

I claim:

1. A leg exercise device for exercising the knee joint of a patient's leg, comprising an elongate rod, the rod being a lever having a cradle at one end of a shape to cradle a lower portion of a patient's leg, a fulcrum member pivotally connected to said lever intermediate its ends and having a leg engagement surface shaped to bear against a patient's leg near its knee joint when said one end cradles such lower leg portion, the pivotable connection of the fulcrum to the lever having an axis transverse to the elongate dimension of said lever; and, a handle carried by the other end of said rod, the handle being useable by a patient to effect articulation of said knee joint.

2. A leg exercising device according to claim 1 further comprising distance adjustment means between said fulcrum member and said cradle.

3. A leg exercising device according to claim 2 wherein said fulcrum member comprises a saddle slidable over said lever, said lever having a plurality of spaced apertures extending part way along it, and distance adjustment means comprising an insertion pin on said saddle which is selectively insertable into any one of said apertures.

4. The device of claim 1 wherein the rod comprises two end to end connected pieces.

5. A leg exercising device for exercising the knee joint of a patient's leg, comprising an elongate rod, the rod being a lever having a cradle at one end of a shape to cradle a lower portion of a patient's leg, a fulcrum member pivotally connected to said lever intermediate its ends and having a leg engagement surface shaped to bear against a patient's leg near its knee joint when said one end cradles such lower leg portion, the pivotal connection of the fulcrum of the lever having an axis transverse to the elongate dimension of said lever, the other of said ends comprising a handle useable by a patient to effect articulation of said knee joint, a saddle slidable along said lever, releasable adjustment means between said saddle and said lever operable to retain said saddle to said lever adjustably for position, a pressure pad, and said pivotal connection comprises a pivot pin connecting said pressure pad and said saddle.

6. A leg exercising device according to claim 5 wherein said saddle comprises a strut between said adjustment means and pivot pin.

7. A leg exercising device for exercising the knee joint of a patient's leg, comprising:

an elongate lever having a cradle at one end of a shape to cradle a lower portion of a patient's leg;

a fulcrum member carried on said lever intermediate its ends and shaped to bear against a patient's leg near its knee joint when said one end cradles such lower leg portion;

the other of said ends comprising a handle useable to a patient to effect articulation of such knee joint;

said lever having an upper portion and a lower portion each of square section tube, said handle being on the upper end of the upper portion and said cradle being on the lower end of the lower portion;

adjacent ends of said lever portions extending laterally and engaging each other telescopically.

8. A leg exercising device according to claim 7 wherein said lower portion of said lever itself comprises telescopically engaging surfaces which provide adjustment of distance between said cradle and said laterally extending lever portion adjacent ends.

9. A leg exercising device according to claim 7 wherein said fulcrum member comprises a contoured pad carried on said laterally extending lever portion adjacent ends.

* * * * *